US011114793B2

(12) United States Patent
Jove Albos

(10) Patent No.: US 11,114,793 B2
(45) Date of Patent: Sep. 7, 2021

(54) ELECTRICAL INSTALLATION FOR CONNECTING MALE TERMINALS TO FEMALE TERMINALS

(71) Applicant: GJM, S.A., La Roca del Valles (ES)

(72) Inventor: Jose Valentin Jove Albos, Coahuila (MX)

(73) Assignee: GJM, S.A., La Roca del Valles (ES)

( * ) Notice: Subject to any disclaimer, the term of this patent is extended or adjusted under 35 U.S.C. 154(b) by 275 days.

(21) Appl. No.: 16/097,726

(22) PCT Filed: May 4, 2017

(86) PCT No.: PCT/IB2017/052592

§ 371 (c)(1),
(2) Date: Oct. 30, 2018

(87) PCT Pub. No.: WO2017/191586

PCT Pub. Date: Nov. 9, 2017

(65) Prior Publication Data

US 2020/0403346 A1 Dec. 24, 2020

(30) Foreign Application Priority Data

May 6, 2016 (MX) ..... MX/A/2016/005972

(51) Int. Cl.
*H01R 13/436* (2006.01)
*H01R 13/50* (2006.01)
(Continued)

(52) U.S. Cl.
CPC ..... *H01R 13/4361* (2013.01); *H01R 13/501* (2013.01); *H01R 13/6273* (2013.01); *H01R 13/5829* (2013.01)

(58) Field of Classification Search
CPC ..... H01R 13/4361; H01R 13/6273; H01R 13/501; H01R 13/5829; H01R 13/585; H01R 12/75
(Continued)

(56) References Cited

U.S. PATENT DOCUMENTS 5,122,081 A * 6/1992 Bogiel et al. ..... H01R 13/422 439/596
5,141,452 A * 8/1992 Yoneda et al. ..... H01R 13/4368 439/595
(Continued)

FOREIGN PATENT DOCUMENTS

WO WO-2014076333 A9 * 2/2015 ..... H01R 43/005
WO WO-2015107034 A1 * 7/2015 ..... H01R 13/501

*Primary Examiner* — Travis S Chambers
(74) *Attorney, Agent, or Firm* — Stanzione & Associates, PLLC; Patrick Stanzione

(57) ABSTRACT

The installation comprises a connector with a body and input openings connected to a housing used for receiving the male terminals. The installation also comprises output openings through which the female terminal wiring is passed, separation walls, side tabs and a first cover hinged to the connector and characterised in that it incorporates a second hinged cover on the aforementioned connector that is facing the first cover, which blocks the side tabs when closed and defines a base, and female terminals made of an electrical conductive material and housed in the connector housing. The female terminals expand when the male terminals are inserted inside them and the area of the housing is greater than the area occupied by the female terminals prior to expanding.

9 Claims, 6 Drawing Sheets

(51) Int. Cl.
*H01R 13/627* (2006.01)
*H01R 13/58* (2006.01)

(58) Field of Classification Search
USPC ..... 439/350, 460, 463, 465, 466, 467, 595, 439/596, 733.1, 752
See application file for complete search history.

(56) References Cited

U.S. PATENT DOCUMENTS

| | | | | | |
|---|---|---|---|---|---|
| 5,713,756 | A * | 2/1998 | Abe | H01R 4/2429 | 439/404 |
| 5,951,326 | A * | 9/1999 | Okabe | H01R 13/506 | 439/596 |
| 6,000,967 | A * | 12/1999 | Norizuki | H01R 13/4362 | 439/596 |
| 7,416,445 | B1 * | 8/2008 | Brown | H01R 13/424 | 439/596 |
| 7,438,594 | B2 * | 10/2008 | Natter | H01R 13/4361 | 439/352 |
| 9,130,295 | B2 * | 9/2015 | Nguyen Nhu | H01R 13/6473 | |
| 9,343,838 | B2 * | 5/2016 | Jove Albos | H01R 13/504 | |
| 2005/0255748 | A1 * | 11/2005 | Kameyama et al. | H01R 13/5208 | 439/587 |
| 2007/0105442 | A1 * | 5/2007 | Gunreben | H01R 13/447 | 439/607.01 |

* cited by examiner

ELECTRICAL INSTALLATION FOR CONNECTING MALE TERMINALS TO FEMALE TERMINALS

FIELD OF THE INVENTION

Electrical installation for connecting male terminals to female terminals, of the type that comprises a connector defining a body and input openings connected to a housing for input male terminals, output openings through which the female terminal wiring is passed, separation walls, side tabs and a first cover hinged to the connector, that comprises a second hinged cover on the said connector, said second hinged cover facing the first cover, such that when closed it blocks the side tabs and defines a base and female terminals made of an electrical conductive material and housed in the connector housing, said female terminals expand when the male terminals inserted inside them wherein the area of the housing is greater than the area occupied by the female terminals prior to expanding.

INVENTION BACKGROUND

Different electrical installations or electrical connectors are known in the art; specifically, in the automotive sector.

Patent PCT WO2015/107034 "AUTOMOTIVE ELECTRICAL WIRING CONNECTOR", from the year 2015, registered to FICO MIRRORS S.A. et al., that is related to an automotive electrical wiring connector is disclosed for being inserted through a small opening. It comprises a body having at least one receiving portion for an electrical conductor end to be connected to a corresponding electrical conductor end, and a lid for covering the electrical conductor receiving portion. The lid is suitable to be in at least one operating position in which the lid is closed to the body an retaining the at least one electrical conductor therein while retaining the connector a body through the small opening, and in at least one non operating position in which the lid is open for allowing the at least one electrical conductor to be accessed and released.

Also known in the art is Spanish Utility Model No. 0262760 "IMPROVED CONNECTOR", from the year 1981, registered to MECANISMOS AUXILIARES INDUSTRIALES, S.A. (MAISA), that relates to an improved connector characterised in that it is comprised of a casing made of insulating and slightly elastic material with a series of openings used for housing the terminals. The casing incorporates a cover capable of spinning around the edge and where both sides of the cover, which incorporate fins on planes sensibly perpendicular to the plane and where each of the fins incorporates slots with a perimeter and configuration that is slightly greater than the respective overhang that exists on each one of the sides of the casing, and where each centre section of the cover incorporates a slot on the free edge of the outer front cover of the casing wall and where the overhand incorporates a protrusion that prevents involuntarily opening the cover.

The requesting company already owns Patent PCT WO2014076333 "METHOD FOR PRODUCING A SEALED CONNECTOR AND RESULTING SEALED CONNECTOR", from the year 2013, related to a procedure that comprises a first phase in which cables are connected to a base with terminals; a second phase in which a protector is placed on at least part of the terminals corresponding to the part of the connector to be overmoulded, said protector being ultrasonically welded to the base, defining a sealed housing for at least the terminals; and third phase comprising the insertion of the assembly from the second phase into a mould and the overmoulding of the protector, part of the base and the part of the cables, defining a pre-determined external overmoulded form and sealing the cables/terminal assembly.

BRIEF DESCRIPTION OF THE INVENTION

The present application is within the field of electrical connectors.

The closest document is a Spanish Utility Model no. 0262760.

This Utility Model solves the problem of fixing the cables inside the connector through a cover containing a series of fins pressing the cable and prevent it from moving.

The problem is due to the fact that the pressure over the wiring does not prevent the female terminal from moving because only the cable is immobilised and therefore, the applied pressure does not prevent the terminal from moving.

The inventor has solved the problem by adding a second cover that allows the female terminal to be positioned properly inside the housing and the covers are blocking in order to prevent the female terminals from moving, that is, on the understanding that initially, the female terminal has been properly locked.

Additionally, the inventor has also noticed that the male terminal becomes frequently separated from the female terminal. This occurs because the movement experienced by the object after use where the terminal is connected (for example, the rear-view mirror of a vehicle), the male terminal becomes disconnected, leaving the unit inoperative.

For this reason, the inventor has developed a new female connector such that at the moment when the male connector is inserted, the female connector expands, resulting in a full contact occurring between both terminals and also, since the female connector tends to recover its initial position, this female connector exerts a constant pressure on the male terminal, thus preventing it from becoming disconnected.

At the same time, due of the female terminal expanding when the male terminal is inserted, the female terminal occupies the housing and becomes fitted and fixed inside it.

An object of this invention is an electrical installation for connecting male terminals to female terminals, of the type that comprises a connector defining a body and input openings connected to a housing for receiving the male terminals, output openings through which the female terminal wiring is passed, separation walls, side tabs and a first cover hinged to the connector and comprising a second hinged cover on the said connector, said second hinged cover facing the first cover, such that when closed it blocks the side tabs and defines a base and female terminals made of an electrical conductive material and housed in the connector housing, said female terminals expand when the male terminals inserted inside them wherein the area of the housing is greater than the area occupied by the female terminals prior to expanding.

BRIEF DESCRIPTION OF THE DRAWINGS

To facilitate the explanation of this specification, six drawings are enclosed representing a practical embodiment, which are provided as a non limiting example of the scope of this invention.

SPECIFIC EMBODIMENT OF THE INVENTION

Figure 1:
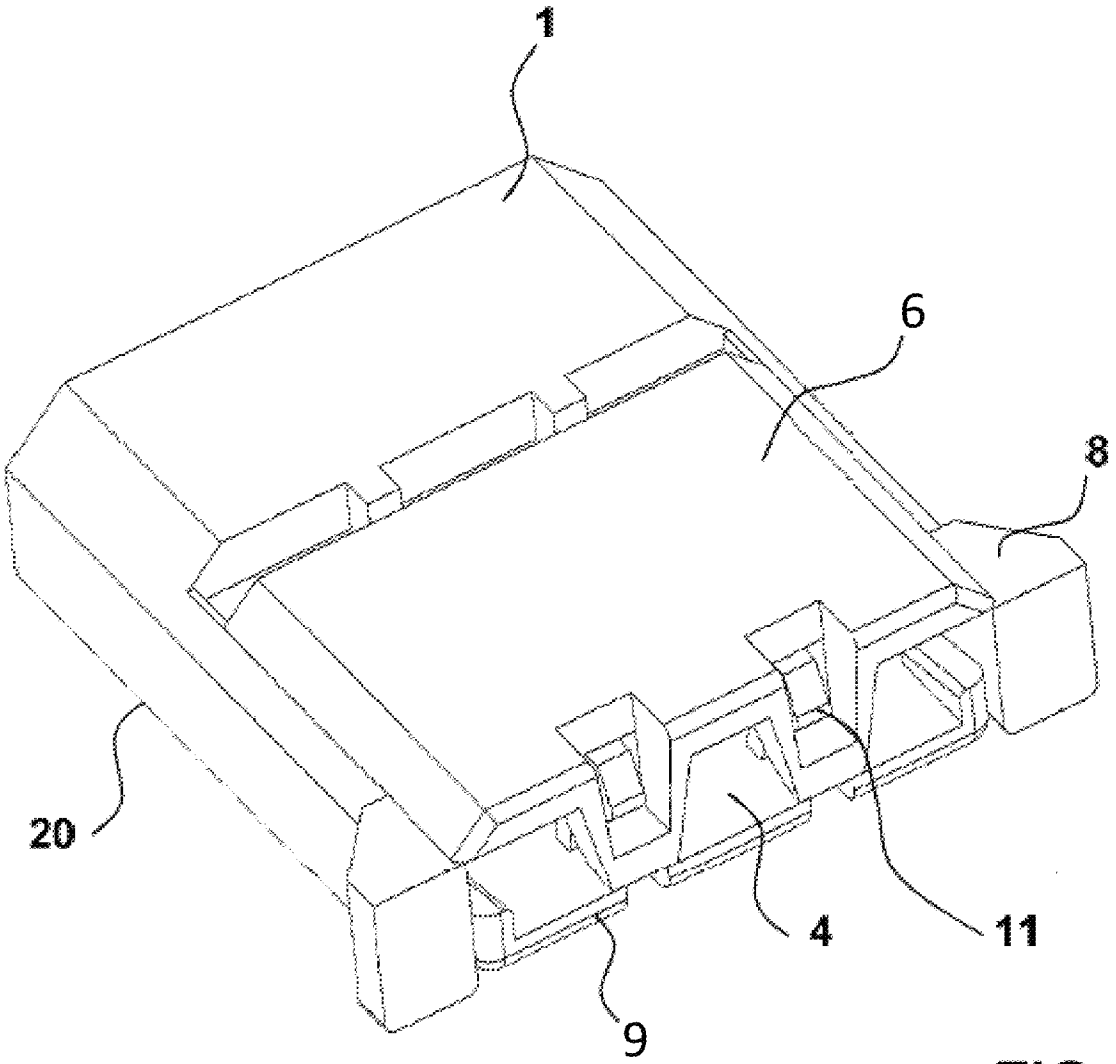
FIG. 1 is a view of the connector with its covers closed.

FIG. 1 shows a connector 20, a body 1, a first cover 6, a second cover 9, some input openings 4, a dual locking mechanism 11, and side tabs 8.

Figure 2:
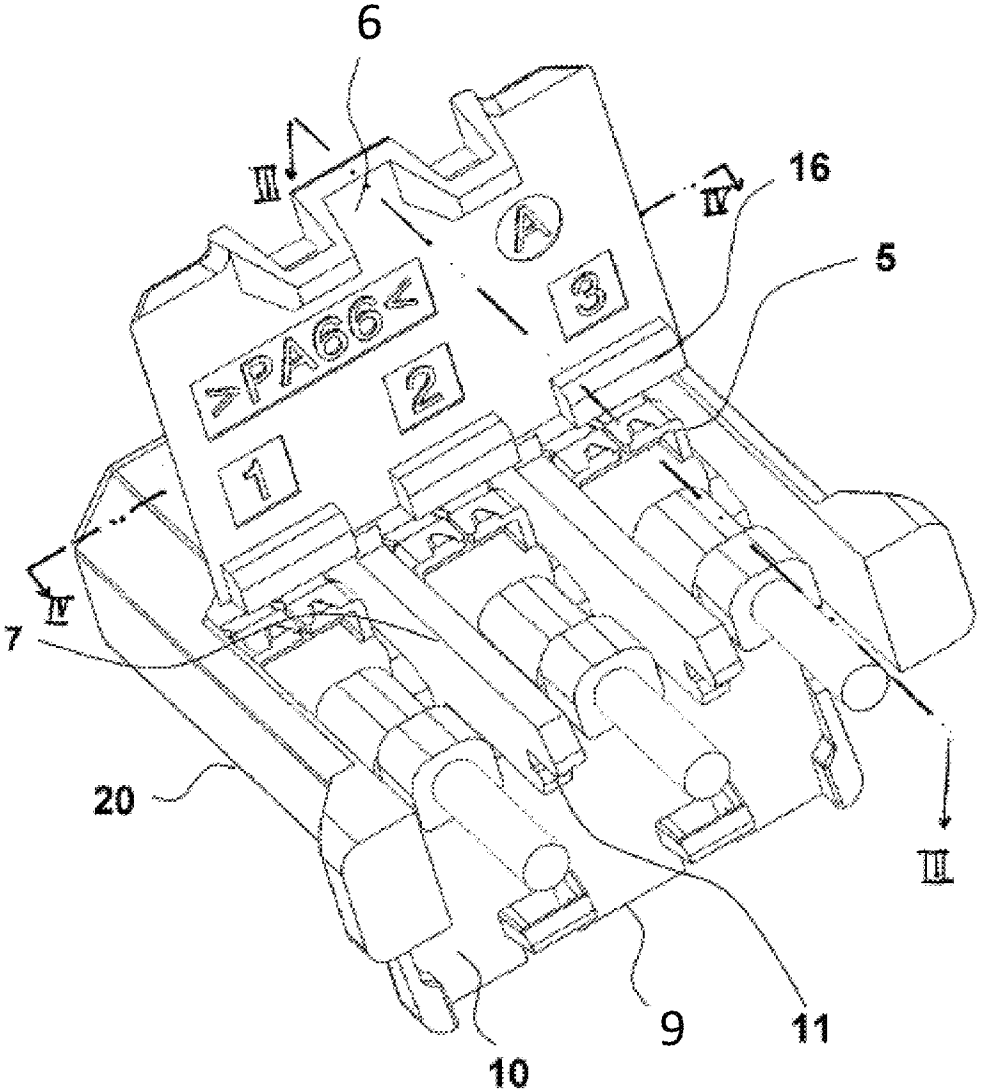
FIG. 2 is a view of the connector with its covers open.

FIG. 2 shows connector 20, the first cover 6, the second cover 9, the dual locking mechanism 11, female terminals 5, locking stoppers 16, separation walls 7 and an inner base 10.

Figure 3:
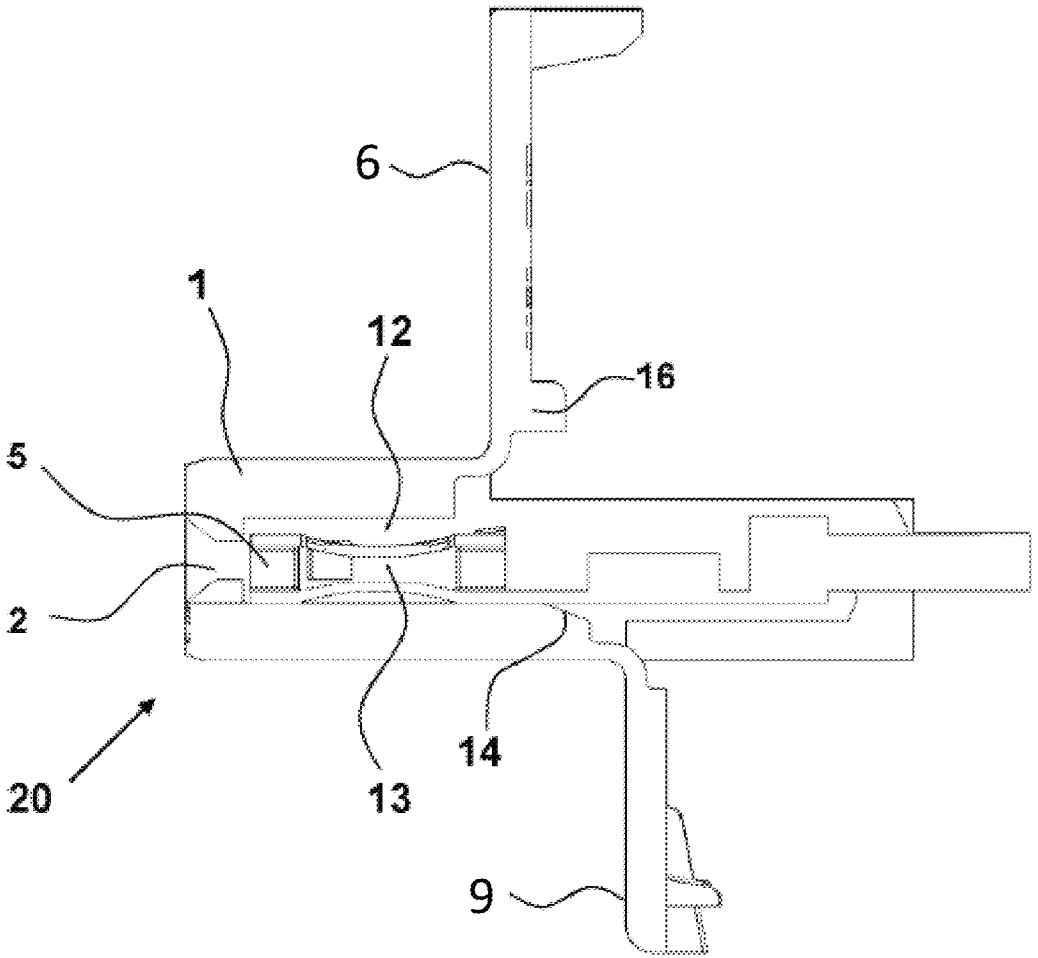
FIG. 3 is a cross sectional view of line III-III of FIG. 2.

FIG. 3 shows connector 20, the body 1, the first cover 6, the second cover 9, the locking stoppers 16, the female terminal 5, input openings 2, a housing 12, an inner space 13 and a descending ramp 14.

Figure 4:
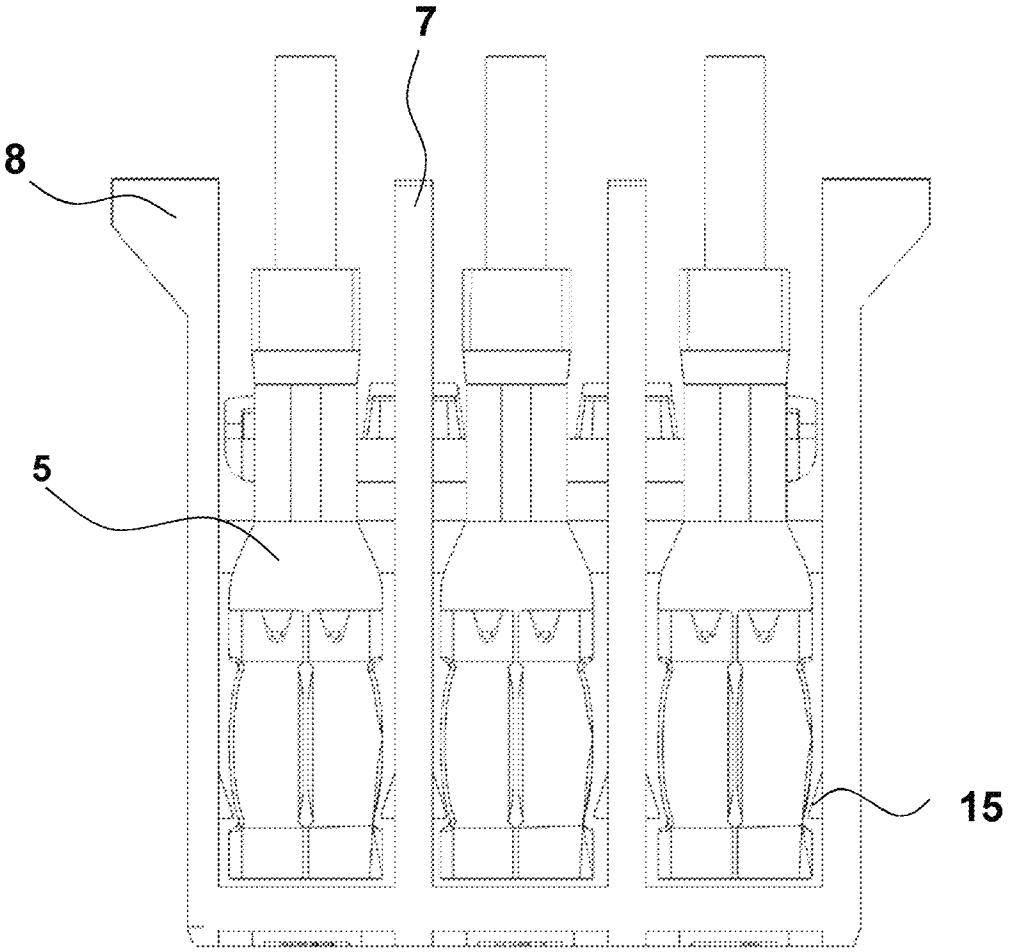
FIG. 4 is a cross sectional view of line IV-IV of FIG. 2.

FIG. 4 depicts the female terminal 5, the side tabs 8, the separator walls 7 and some positioning stoppers 15.

Figure 5A:
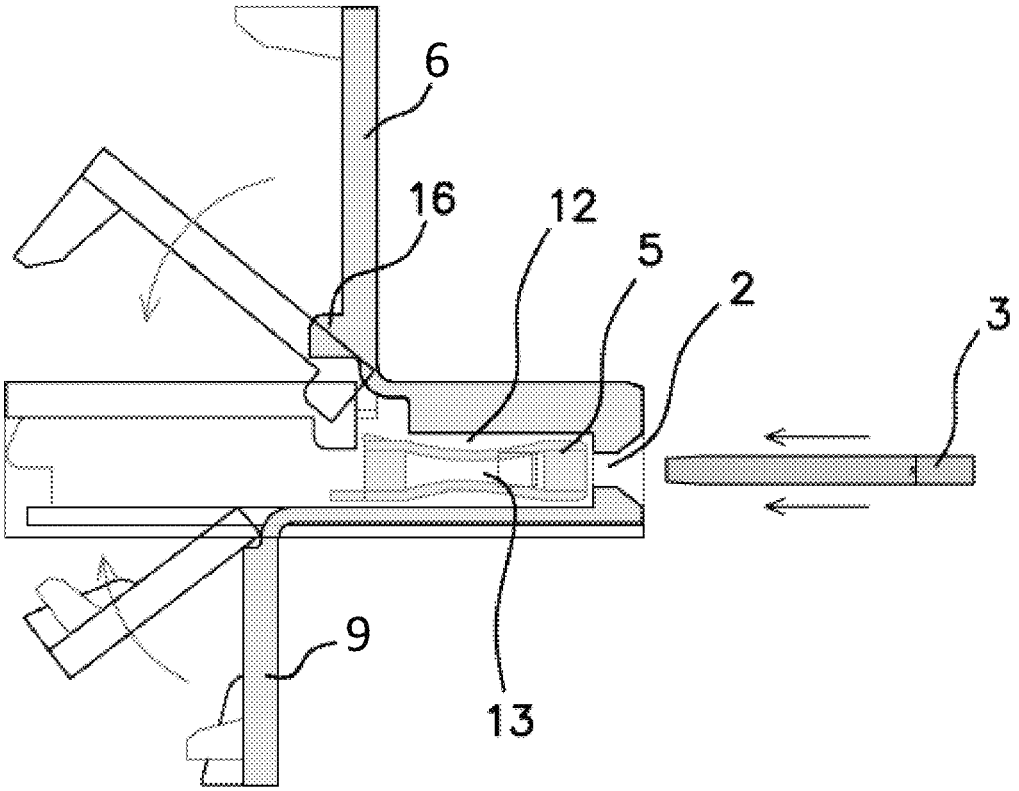
FIGS. 5*a* and 5*b* are a view of the operation of the female terminal after having eliminated elements and shortened others (such as the female terminal).

FIG. 5*a* shows the first cover 6, the second cover 9, the female terminal 5 with its inner space 13, the locking stoppers 16, the housing 12, the input openings 2 and some male terminals 3.

Figure 5B:
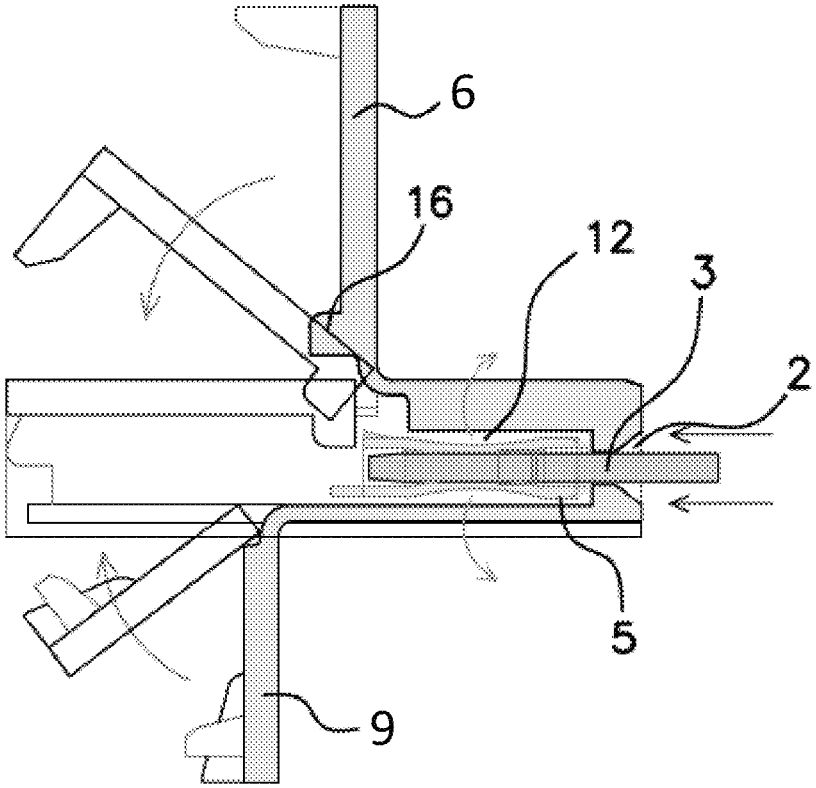

Lastly, FIG. 5*b* shows the first cover 6, the second cover 9, the female terminal 5, the housing 12, the locking stoppers 16, the input openings 2 and the male terminals 3.

Therefore, in a specific embodiment, the electrical installation for connecting male terminals to female terminals, a connector 20 as well as some male terminals 3 and female terminals 5.

Connector 20 defines a body 1. This body 1 incorporates input openings 2 connected to a housing 12. These input openings 2 allow male terminals 3 to enter.

It also comprises some input openings 4 through which the female terminal 5 wiring is passed.

Inside the body there are separation walls 7 used for separating the female terminal 5 wires, side tabs 8 for positioning the connector 20 and a first cover 6 hinged to the connector 20.

The body also comprises a second cover 9 that is hinged to the said connector 20 and faces the first cover 6 when both covers 6, 9 are closed. When the second cover 9 is closed, it locks the side tabs 8, preventing them from moving. Also, this second cover 9 incorporates a base 10 that delimits the female terminal 5.

Once the covers 6,9 are closed, the connector is inserted in the element onto which a rear-view mirror fits, for example.

The said female terminals 5 are made of electrical conductive material in order to conduct the electricity to the male terminal 3 when it is inserted in the female terminals 5 or vice versa.

The female terminals 5 are housed in the housing 12 of connector 20.

The female terminals 5 expand when they receive the male terminals 3. When inserted, the male terminals 3 push the female terminals 5 outward and expand them (FIGS. 5*a* and 5*b*).

For this reason, the space in the housing 12 is larger than the space occupied by the female terminals 5 prior to expanding, since the male terminal 3 pushes the walls of the second connector 5 outward when it is being inserted in the inner space 13, occupying space inside the housing 12 and thus reducing its space.

For example, as an option, the female terminals 5 form a convex shape; in other words, they have a curvature towards the inner space 13, such that when the male terminals 3 are inserted in the inner spaces 13, they push these convexities outward, occupying space inside the housing 12.

This also allows making a safe connection between both terminals 3,5 since the female terminal 5 tends to recover the convexity and therefore pushes against the male terminal 3 and vice versa; the male terminal 3 pushes outward on the convexities of the female terminal 5 for a perfect fitting.

Also as an option, the female terminal 5 can be configured so that when the male terminals 3 are inserted and expand the female terminals 5, these female terminals 5 become fitted inside the housing 12 as a result of the expansion.

As an option, both covers 6, 9 may be of different sizes and in this embodiment, the first cover 6 is larger than the second cover 9. The reason for this is to facilitate the positioning of the female terminals 5 inside the housing 12.

To facilitate closing the covers 6, 9, the separator walls 7 comprise a dual locking mechanism 11 on one of their ends, which locks the first cover 6 and the second cover 9, closing the connector 20.

Also as an option, a descending ramp 14 may be added, which would be located on the inner base 10 and ends on the second cover 9. The function of this ramp 14 is to help insert the female terminals 5 inside the housing 12.

This way, when the operator is holding the connector 20 in his hand, he would open both covers 6, 9 and would position the female terminals 5, which would be separated by the separator walls 8.

Then the covers 6, 9 are closed, which then locked the side tabs 8 and said covers 6, 9 house said female terminals 5 inside the housing 12 of connector 20.

Subsequently, connector 20 along with the female terminal 5 wiring is installed, for example, in a rear-view mirror.

Then, the male terminals 3 are passed through the input openings 2 inside the housing and then inserted inside the female terminals 5 inside the inner space 13, expanding the female terminal 5, improving the connection and fixing these terminals 3, 5 to each other.

If the female terminal 5 wiring were pulled, the terminal would not be pulled out because both covers 6, 9 would need to be opened in order to release the female terminal 5. The positioning stoppers 15 also help prevent movements.

Likewise, the existence of the locking stoppers 16 prevent the female terminal from moving, as shown in FIGS. 5*a* and 5*b*. This point is important because the close art comprises the blocked cable, which damages the cable as a result of the pressure, while in this case the longitudinal movement of the female terminal 5 is locked, which does not cause any damage.

The locking stoppers 16, once the second cover 9 is closed, leave a space below to extend the female terminal 5, resulting in the female terminal 5 being fully fitted in place, preventing it from being pulled out of the connector 20.

Also, a simple pull will not release the male terminal 3 from the female terminal 5; an intentional vigorous stretching is required to disconnect the terminals.

This invention describes a new installation used for connecting male and female terminals. The examples mentioned herein are non-limiting of this invention; and therefore, it can have different applications and/or adaptations all comprised within the scope of the following claims.

The invention claimed is:

1. A connector assembly for connecting male terminals to female terminals that comprises:

a connector (20) defining a body (1) and input openings (2) which communicate with a housing (12) for input male terminals (3);

output openings (4) through which female terminal (5) wiring is passed;

separation walls (7);

a first cover (6) hinged to the connector (20);

a second cover (9) comprising a base (10) and hinged to the said connector (20) and facing the first cover (6);

female terminals (5) made of an electrical conductive material and housed in the housing (12) of the connector (20), which expand when the male terminals (3) are inserted inside them, and wherein a space in the housing (12) is larger than a space occupied by the female terminals (5) prior to expanding; and side tabs (8) extending outward from opposite sides of the connector (20) body (1) such that the first cover (6) and the second cover (9) lock together between the side tabs (8) to block in the female terminals (5) when the first cover (6) and second cover (9) are closed.

2. The connector assembly in accordance with claim 1, wherein the separator walls (7) incorporate a dual locking mechanism (11) on one of their ends, which locks the first cover (6) and the second cover (9), closing the connector.

3. The connector assembly in accordance with claim 1, wherein the female terminals (5) are blocked inside the housing (12) once the male terminals (3) are inserted and the female terminals (5) expand.

4. The connector assembly in accordance with claim 1, further comprising a descending ramp (14) located inside the housing (12) which ends on the second cover (9).

5. The connector assembly in accordance with claim 1, further comprising locking stoppers (16) on the first cover (6).

6. The connector assembly in accordance with claim 1, wherein the size of the first cover (6) is different than that of the second cover (9).

7. The connector assembly in accordance with claim 6, wherein the size of the first cover (6) is larger than that of the second cover (9).

8. The connector assembly in accordance with claim 1, wherein the female terminals (5) form a convex shape, reducing an inner space (13) wherein the male terminals (3) are housed.

9. The connector assembly in accordance with claim 8, wherein the female terminals (5) are fitted inside the housing (12) once the male terminals (3) are inserted and the female terminals expand.

* * * * *